US006771027B2

(12) United States Patent
Hansen

(10) Patent No.: US 6,771,027 B2
(45) Date of Patent: Aug. 3, 2004

(54) SYSTEM AND METHOD FOR ADJUSTING FIELD EMISSION DISPLAY ILLUMINATION

(75) Inventor: Ronald L. Hansen, San Jose, CA (US)

(73) Assignee: Candescent Technologies Corporation, San Jose, CA (US)

( * ) Notice: Subject to any disclaimer, the term of this patent is extended or adjusted under 35 U.S.C. 154(b) by 0 days.

(21) Appl. No.: 10/302,063

(22) Filed: Nov. 21, 2002

(65) Prior Publication Data

US 2004/0108976 A1 Jun. 10, 2004

(51) Int. Cl.[7] ..... G09G 3/10

(52) U.S. Cl. ..... 315/169.1; 315/169.3; 345/75.2; 345/84; 345/100; 345/214

(58) Field of Search ..... 315/169.3, 169.1, 315/169.2, 291, 307; 345/55, 63, 84, 98, 100, 75.2, 211, 212, 214

(56) References Cited

U.S. PATENT DOCUMENTS

| | | | | | |
|---|---|---|---|---|---|
| 5,216,504 | A | | 6/1993 | Webb et al. | 358/139 |
| 5,541,473 | A | * | 7/1996 | Duboc et al. | 313/422 |
| 5,559,389 | A | * | 9/1996 | Spindt et al. | 313/310 |
| 5,564,959 | A | * | 10/1996 | Spindt et al. | 445/24 |
| 5,578,899 | A | * | 11/1996 | Haven et al. | 313/422 |
| 5,607,335 | A | * | 3/1997 | Spindt et al. | 445/50 |
| 5,608,283 | A | * | 3/1997 | Twichell et al. | 313/309 |
| 5,708,451 | A | | 1/1998 | Baldi | 345/75 |
| 5,898,415 | A | * | 4/1999 | Hansen et al. | 345/74.1 |
| 6,037,918 | A | * | 3/2000 | Hansen et al. | 345/74.1 |
| 6,060,840 | A | | 5/2000 | Foo et al. | 315/169.1 |
| 6,069,597 | A | * | 5/2000 | Hansen | 345/74.1 |
| 6,069,598 | A | * | 5/2000 | Hansen | 345/74.1 |
| 6,147,664 | A | * | 11/2000 | Hansen | 345/74.1 |
| 6,169,529 | B1 | * | 1/2001 | Hansen et al. | 345/74.1 |
| 6,307,327 | B1 | | 10/2001 | Xie et al. | 315/169.4 |
| 6,429,835 | B1 | | 8/2002 | Browning et al. | 345/74 |
| 6,465,966 | B2 | | 10/2002 | Konuma | 315/169.1 |

* cited by examiner

*Primary Examiner*—Haissa Philogene
(74) *Attorney, Agent, or Firm*—Wagner, Murabito & Hao LLP

(57) ABSTRACT

The present invention is a system and method for monitoring FED performance and compensating for adverse impacts associated with display emission generation. A present invention FED adjustment system and method is capable of providing real time emission characteristic monitoring during retrace periods. In one present emission compensation method a feedback type process is utilized that drives a constant level on dummy pixels not included in the active viewing area and compares the results (e.g., the current that is associated with the emission) to an expected certain predetermined amount. If the current is too high then the voltage supply is reduced to the drive level or if the current is to low the voltage is increased. A driver voltage is supplied and an image is presented in an active pixel region during an active presentation time. Emissions are produced in a test pixel during a nonactive presentation and a determination is made if the emissions in the test area are accurate. If the emissions are not accurate, adjustments to the pixels are made to provide a desired level.

24 Claims, 5 Drawing Sheets

300

500

300

SYSTEM AND METHOD FOR ADJUSTING FIELD EMISSION DISPLAY ILLUMINATION

BACKGROUND OF THE INVENTION

1. Field of the Invention

This invention relates to the field of information displays. In particular, the present invention relates to a system and method for efficiently adjusting display devices.

2. Related Art

Electronic systems and circuits have made a significant contribution towards the advancement of modem society and are utilized in a number of applications to achieve advantageous results. Numerous electronic technologies such as digital computers, calculators, audio devices, video equipment, and telephone systems have facilitated increased productivity and reduced costs in analyzing and communicating data in most areas of business, science, education and entertainment. Frequently, these electronic technologies are utilized to convey information. Displaying information in a visual presentation is usually a convenient and effective method of conveying the information. However, poor quality or distorted displays typically impede information presentation and user comprehension. There are a number of conditions that adversely effect the performance of the display components and interfere with the presentation of information.

Numerous electronic systems and devices are utilized to convey information. For example, computer systems typically include a display monitor for displaying information. Display devices such as cathode ray tube (CRT) devices and field emission display (FED) devices usually generate light by impinging high-energy electrons on a picture element (pixel) of a phosphor screen and the phosphor converts the electron energy into visible light. The emitted light is utilized to convey images to observers and the properties of the emitted light have a significant impact on the perceptibility of the presentation. Typically, the greater the light emission the greater the presentation clarity.

Different types of displays such as cathode ray tubes (CRTs) and field emission devices (FEDs) usually differ in the manner in which the high energy electrons are impinged on a pixel. Conventional CRT displays typically use a single electron beam, or in some cases three electron beams, to scan across the phosphor screen in a raster pattern. FEDs usually utilize stationary electron beams for each color element of each pixel, enabling the distance from the electron source to the screen to be very small compared to the distance required for the scanning electron beams of a conventional CRT. In addition, the vaccum tube of the FED is usually made of much thinner glass and consumes less power than a conventional CRT.

The performance of components in field emission displays is usually impacted by a variety of conditions. FED devices rely upon a predetermined relationship between current utilized to drive illumination and the emission characteristics of a pixel. The FED devices are usually driven with a predetermined voltage designed to result in a particular current that produces a particular display intensity. However, various conditions (e.g., temperature changes) can have an adverse impact on FED components over time, such as changes in emission characteristics that alter the relationship between drive current and illumination. For example, at one time a FED may be driven with a specific amount of voltage resulting in a specific current and at some later time when driven at exactly at the same drive level voltage, the current is something different due to emission characteristic changes. Since the amount of current ultimately determines the brightness of a display presentation, displays typically get brighter or dimmer over time, depending upon the nature of the changes that occur to the components (such as at the cathode). The effects of these detrimental environmental conditions often adversely impact the presentation of information and images on a field emission display.

Traditional attempts at compensating for adverse environmental conditions, such as measuring temperature at a cathode, often encounter difficulties. For example, compensating for thermal lags that do not permit measurement in real time often poses problems. Another problem with traditional approaches is they are often limited in scope. For example, limiting an attempt to temperature measurement typically does not address other adverse conditions, such as emission deterioration caused by contamination. If some other mechanism other than temperature is causing problems, it is very difficult to detect the problem if the temperature remains stable throughout the changes.

What is required is a system and method for monitoring FED performance and compensating for adverse impacts on display emission generation.

SUMMARY OF THE INVENTION

The present invention is a system and method for monitoring field emission display (FED) performance and compensating for adverse impacts associated with display emission generation. A present invention FED adjustment system and method is capable of providing real time emission characteristic monitoring during retrace periods. In one present emission compensation method, a feedback type process is utilized that drives a constant voltage level on test pixels not included in the active viewing area and compares the results (e.g., the current or illumination that is associated with the emission) to an expected predetermined result (e.g., amount of current or illumination). For example, if a measured parameter (e.g., illumination, current, etc.) associated with the test pixel is too high then the voltage supply is reduced on the drive level or if the measured parameter is too low the voltage is increased. In one embodiment of the present invention, a driver voltage is supplied and an image is presented in an active pixel region during an active presentation time. Emissions are produced in a test pixel during a nonactive presentation time and a determination is made if the emissions in the test area are accurate. If the emissions are not accurate, adjustments to the pixels are made to provide a desired level.

DETAILED DESCRIPTION OF THE INVENTION

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one ordinarily skilled in the art that the present invention may be practiced without these specific details. In other instances, well known methods, procedures, components, and circuits have not been described in detail as not to unnecessarily obscure aspects of the current invention.

Figure 1:
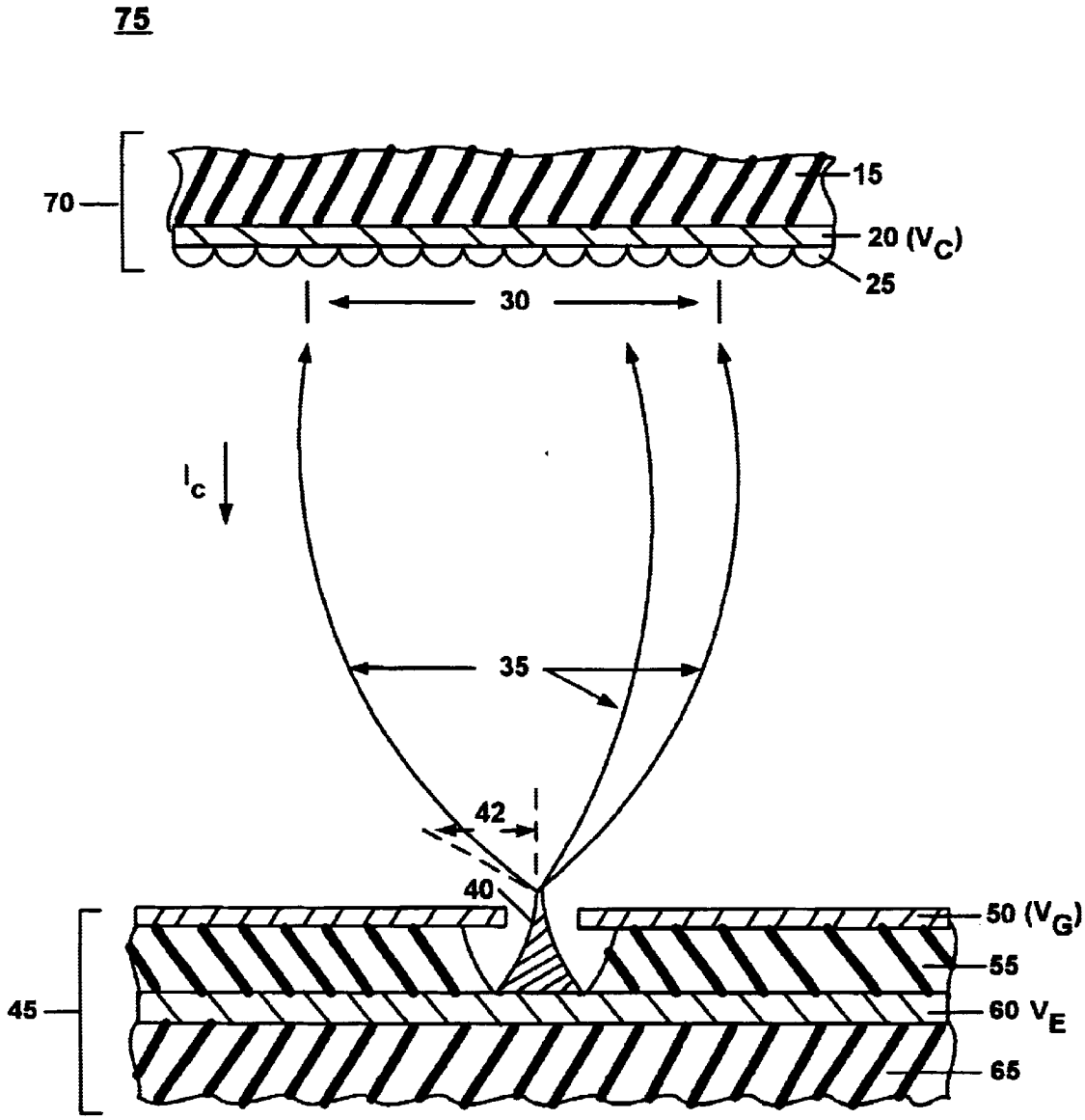
FIG. 1 illustrates a multi-layer structure which is a cross-sectional view of a portion of an FED flat panel display implementation of one embodiment of the present invention.

FIG. 1 illustrates a multi-layer structure 75 which is a cross-sectional view of a portion of one embodiment of a flat panel field emission display (FED). The multi-layer structure 75 contains a field-emission backlplate structure 45, also called a baseplate structure, and an electron-receiving faceplate structure 70. An image is generated at faceplate structure 70. Backplate structure 45 commonly comprises an electrically insulating backplate 65, an emitter electrode 60, an electrical insulating layer 55, a patterned gate electrode 50, and an electron emissive element 40 situated in an aperture through insulating layer 55. One type of electron-emissive element 40 is described in U.S. Pat. No. 5,608,283, issued on Mar. 4, 1997 to Twichell et al. and another type is described in U.S. Pat. No. 5,607,335, issued on Mar. 4, 1997 to Spindt, et al. which are both incorporated herein by reference. The tip of the electron-emissive element 40 is exposed through a corresponding opening in gate electrode 50. Faceplate structure 70 is formed with an electrically insulating faceplate 15, an anode 20, and a coating of phosphors 25. Electrons emitted from element 40 are received by phosphors portion 30. In one embodiment, electron emissive element 40 includes a conical molybdenum tip. In other embodiments of the present invention, the anode 20 may be positioned over the phosphors 25, and the emitter 40 may include other geometrical shapes such as a filament, carbon fiber or nanotubes.

The emission of electrons from the electron-emissive element 40 is controlled by applying a suitable voltage (VG) to the gate electrode 50. Another voltage (VE) is applied directly to the electron-emissive element 40 by way of the emitter electrode 60. Electron emission increases as the gate-to emitter-voltage (e.g., VG minus VE) is increased. Directing the electrons to the phosphor 25 is performed by applying a high voltage Vc to the anode 20. When a suitable gate-to-emitter voltage (VGE) is applied, electrons are emitted from electron-emissive element 40 at various values of off-normal emission angle theta 42. The emitted electrons follow nonlinear (e.g. parabolic) trajectories indicated by lines 35 in FIG. 1 and impact on a target portion 30 of the phosphors 25. Thus, VG and VE determine the magnitude of the emission current (IC) while the anode voltage (VC) controls the direction of the electron trajectories for a given electron emitted at a given angle.

Figure 2:
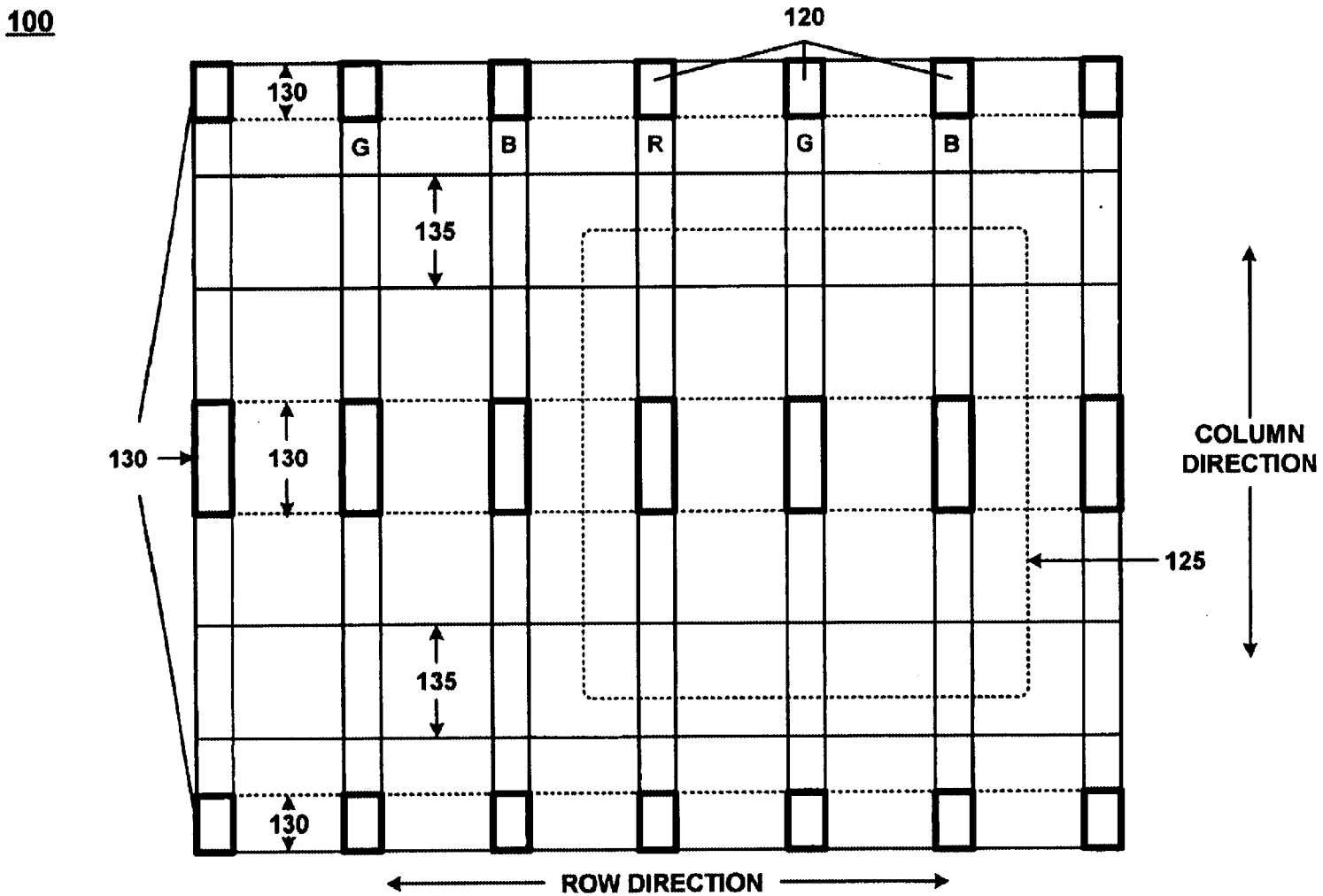
FIG. 2 illustrates a portion of an exemplary FED screen utilized in one embodiment of the present.

FIG. 2 illustrates a portion of an exemplary FED screen 100. The FED screen 100 is subdivided into an array of horizontally aligned rows and vertically aligned columns of pixels. The boundaries of a respective pixel 125 are indicated by dashed lines. Three separate row lines 130 are shown, and each row line 130 is a row electrode for one of the rows of pixels in the array. In one embodiment, each row line 130 is coupled to the emitter cathodes of each emitter in the particular row associated with the electrode. Alternately, each row line can be coupled to the gate electrode of each emitter in the particular row associated with the electrode. A portion of one pixel row is indicated in FIG. 2 and is situated between a pair of adjacent spacer walls 135. In an alternate embodiment, spacer walls 135 may not be present. A pixel row includes all of the pixels along one row line 130. Two or more pixel rows (e.g., 24–100 pixel rows) are generally located between each pair of adjacent spacer walls 135.

In color displays each column of pixels generally has three column lines 120; (1) one for red; (2) a second for green; and (3) a third for blue. Likewise, each pixel column includes one of each phosphor stripes (red, green, blue), three stripes total. In a monochrome display, each column contains only one stripe. In the present embodiment, each of the column lines 120 is coupled to the gate electrode of each emitter structure in the associated column. Alternatively, each of the column lines could be coupled to the emitter cathode of each emitter structure in the associated column. Further, in the present embodiment, the column lines 120 are coupled to column driver circuits (not shown) and the row lines 130 are coupled to row drivers circuits (not shown).

In operation the red, green and blue phosphor stripes are maintained at a high positive voltage relative to the voltage of the emitter-cathode 60/40. When one of the sets of electron-emission elements is suitably excited by adjusting the voltage of the corresponding row lines 130 and column lines 120, elements 40 in that set emit electrons which are accelerated toward a target portion 30 of the phosphors in the corresponding color. The excited phosphors then emit light. During a screen frame refresh cycle (performed at a rate of approximately 60 HZ in one embodiment), only one row is active at a time and the column lines are energized to illuminate the one row of pixels for the on-time period. This is performed sequentially in time, row by row until all pixel rows have been illuminated to display the frame. The above FED configuration is described in more detail in the following United States Patents: U.S. Pat. No. 5,541,473 issued on Jul. 30, 1996 to Duboc, Jr. et al.; U.S. Pat. No. 5,559,389 issued on Sep. 24, 1996 to Spindt et al.; U.S. Pat. No. 5,564,959 issued on Oct. 15, 1996 to Spindt et al.; and U.S. Pat. No. 5,578,899 issued Nov. 26, 1996 to Haven et al.; which are incorporated herein by reference.

In one embodiment of the present invention, one or more of the pixels in an FED are test pixels. The test pixel emitters are fabricated in the same way as the other pixel emitters (e.g., on a cathode) so that mechanically, functionally, and operationally the test pixels substantially mimic the pixels utilized to present an image.

There are a variety of implementations for monitoring the performance of the test pixels. In one embodiment, basic feedback algorithms can be utilized. In one embodiment of the present invention, a current supplied to a test pixel emitter is measured at a particular drive voltage (e.g., an "on" voltage, a maximum voltage, etc.). The measured current is compared to a predetermined anticipated current measurement for the particular drive level. If the current levels match no adjustment is made to the drive level. However, if the measured and anticipated currents do not match an appropriate adjustment is made to the drive levels. For example, if the measured current is less than the anticipated current an adjustment is made in the drive level to bring the measured current up to match the anticipated current. There are a variety of mechanisms for actually measuring the current (e.g., a standard current measuring technique is providing and is not discussed in detail so as not to obscure the present invention.

In an alternate embodiment, illumination of a test pixel emitter is measured at a particular drive voltage (e.g., an "on" voltage, a maximum voltage, etc.). The measured illumination is compared to a predetermined anticipated illumination measurement for the particular drive level. If the illumination levels match no adjustment is made to the drive level. However, if the measured and anticipated illumination do not match an appropriate adjustment is made to the drive levels. For example, if the measured illumination is less than the anticipated illumination an adjustment is made in the drive level to bring the measured illumination up to match the anticipated illumination.

The present invention is adaptable to continuous adjustment. In another embodiment there is a quantified level of steps. Once the measured current crosses a boundary it goes to a specific value and holds there until it crosses the boundary again. In one exemplary implementation, there are provisions for an error band in the analysis. For example, as long as the current is within a predetermined percentage of a desired value there is no change in the supply.

Figure 3:
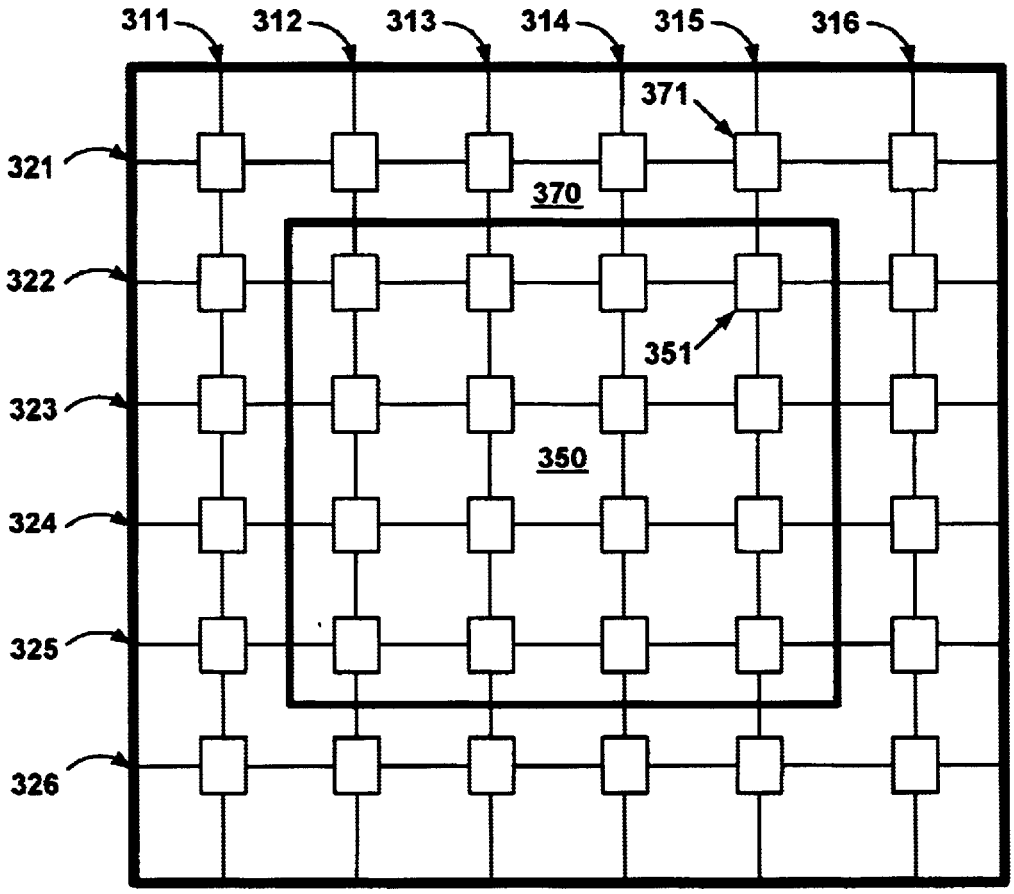
FIG. 3 is an schematic of an adjusting FED, one embodiment of the present invention.

FIG. 3 is one embodiment of schematic of FED 300, of the present invention. FED 300 comprises pixels (e.g., 371 and 351) aligned in rows 321 through 326 and columns 311 through 316. Pixels in rows 322 through 325 and columns 312 through 315 are included in active viewing area 320. Pixels in rows 321 and 326 are considered "dummy pixels" because they are not in the active viewing area and therefore do not impact the perceived presentation. In one embodiment of the present invention the test pixels are included in dummy rows.

In an alternate embodiment the test pixels are included in the active area. In one exemplary implementation of the present invention, a row within the active area (e.g., a row close to the edge of the active viewing area boundary) is utilized as the test row. Even though technically it is in active area it is a boundary row and the impact of the presentation is minimal.

In one embodiment of the present invention, a correspondence exists between test pixels and other pixels in the FED. For example, test pixels can be included on the same drive source (e.g., in the same column) as other pixels and similar changes in emission characteristics occur in the test pixels and the active area pixels on the same driver (e.g., same cathode). Therefore, the drive for the pixels on the same driver (e.g., same cathode) are adjusted to compensate for changes between anticipated and measured currents on the test pixel emitters. In one embodiment of the present invention, an FED includes a high voltage power supply that provides high voltage potential to the test pixels and the current that the power supply is providing is monitored.

One exemplary implementation of the present invention permits the test operations to be distinguished from normal image presentation. For example, test pixels in dummy rows can be driven at a specific level and the emission current and/or illumination monitored independent of pixels in an active area (e.g., the dummy pixels are outside the active area). In one embodiment of the present invention, the emissions from the test emitter and an active presentation emitter are differentiated with respect to time. In one exemplary implementation, for a first duration of time, emissions are allowed from an emitter involved in an active presentation of an image (e.g., an emitter in the active area) and for a second duration of time an emitter involved in a test operation (e.g., an emitter in a dummy row).

The present invention is readily adaptable for a variety of implementations. For example, existing video standards have a vertical blanking period and the present invention is compatible with a variety of video standards. Most video displays have a retrace time, typically anywhere from 2% to 15% of the total amount of time information is displayed. Historically it comes from the standard retrace time of a CRT, so typically 80 to 90 percent of the time a display is on it is emitting from the active area and a user is seeing the picture. The remaining nominal 10 percent or so of the time is the retrace time and the active area is not emitting. In one embodiment of the present invention, the retrace time is chosen to perform the emission from the test or monitoring emitters (e.g., an emitter in a dummy row). In one exemplary implementation the current supplied to the test emitters during that retrace time is measured and compared to a standard predetermined value. If the measured value is high or low a corresponding adjustment is made to the drive level during presentation of an image.

In one embodiment of the present invention, the test pixels are not activated every retrace period permitting a conservation of power. The test pixels operate in a normal vertical blanking period in which no current is consumed or dissipated. This is particularly beneficial in a power sensitive environment in which a trade off may be critical. In one embodiment where power consumption is critical testing is performed on demand rather than continuously (e.g., once every 5 frames–100 frames).

From a practical standpoint, not every application requires continuous adjustments to compensate for emission changes. In some applications, the cathode does not change over short periods of time (e.g., on the order of milliseconds). Rather they are measured in much longer duration such as days, so there is not always a need to make adjustments on every frame. There are a variety of things that can be done with the compensation information. For example it can be run in real time and/or a permanent or nonvolatile record may be made. For example, when the FED is turned off, the information is stored even if an election is made not to do the compensation until the next time the FED is turned on.

Figure 4:
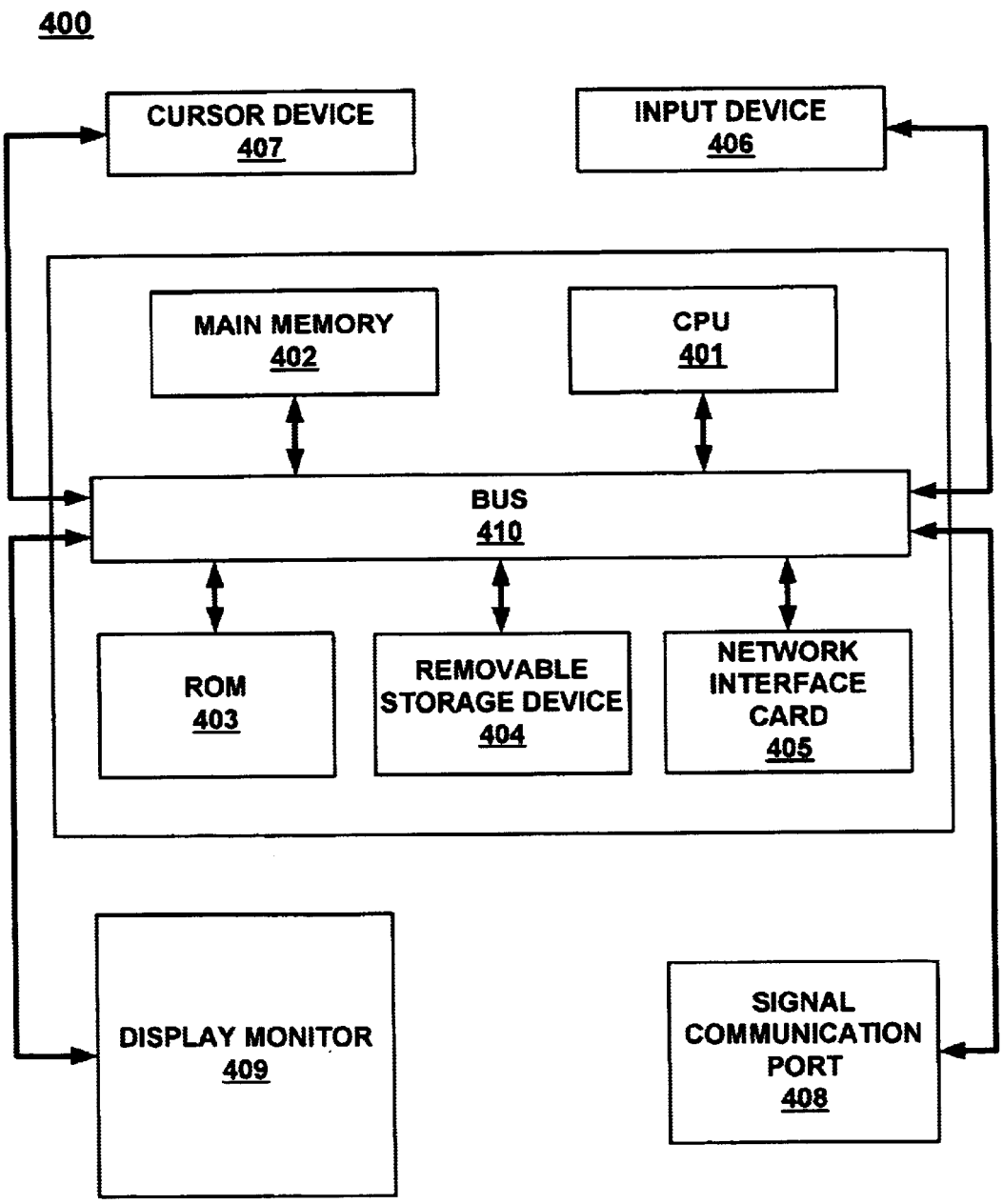
FIG. 4 is a block diagram of one embodiment of a computer system utilizing a present invention FED.

FIG. 4 is a block diagram of one embodiment of a computer system 400 upon which the present invention is implemented. Computer system 400 includes address/data bus 410, central processor unit 401, main memory 402 (e.g., random access memory), static memory 403 (e.g., read only memory), removable data storage device 404, network interface card (NIC) 405, input device 406 cursor device 407, display monitor 409, and signal communications port 408. Address/data bus 410 is coupled to central processor units 401A, 401B, 401C, main memory 402, static memory 403, removable data storage device 404, network interface card 405, input device 406 cursor device 407, display monitor 409, and signal communications port 408.

The components of computer system 400 cooperatively function to provide a variety of functions, which include presentation of information on display monitor 409 with automatic adjustments for adverse emission changes. Address/data bus 410 communicates information, central processor 401 processes information and instructions, main memory 402 stores information and instructions for the central processor 401 and static memory 403 stores static information and instructions. Removable data storage device 404 also stores information and instructions (e.g., functioning as a large information reservoir). NIC 405 coordinates the communication of information to and from computer system 400 via signal communication port 408. Display device 409 displays information with automatic adjustments for adverse emission characteristics. Cursor device 407 provides a mechanism for pointing to or highlighting information on the display device. Input device 406 provides a mechanism for inputting information.

Figure 5:
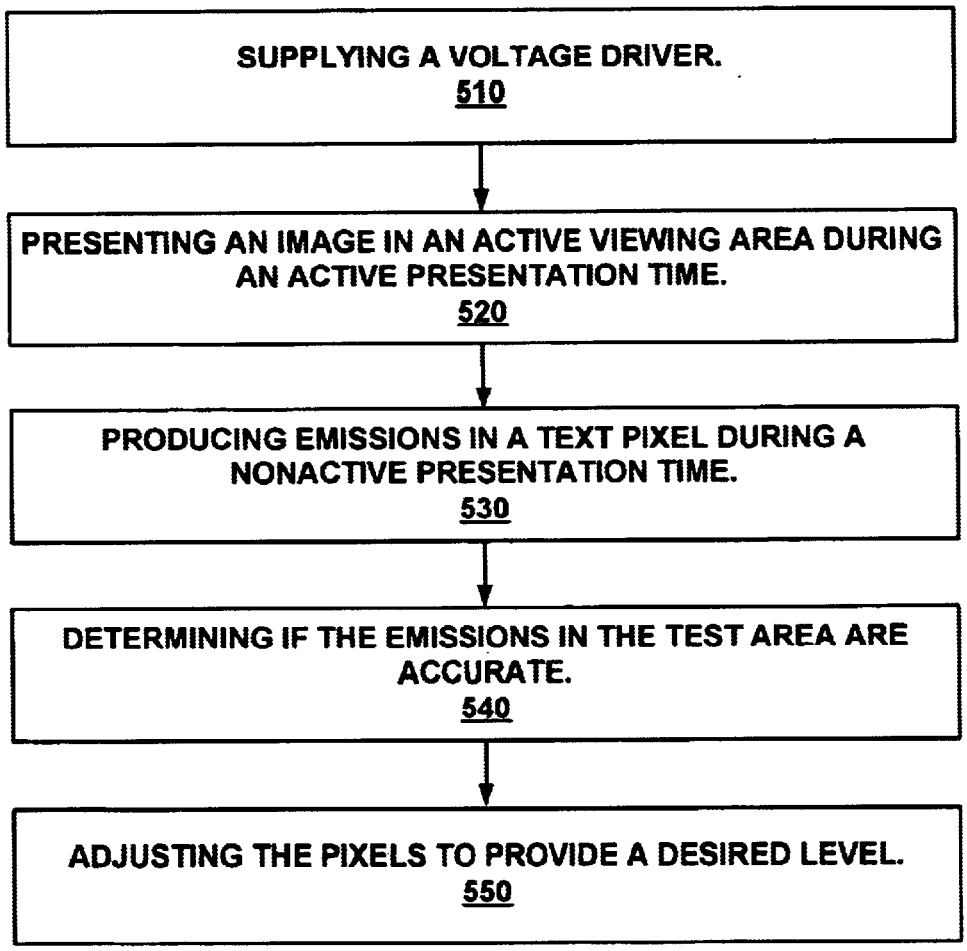
FIG. 5 is a flow chart of an emission compensation method, one embodiment of the present invention.

FIG. 5 is a flow chart of one embodiment of emission compensation method 500, of the present invention.

In step 510, a voltage driver is supplied. In one embodiment of the present invention the voltage driver is a signal from a high voltage power supply.

An image is presented in an active pixel during and active presentation time during step 520. In one embodiment of the present invention, the pixels are created by field emission cathodes.

Emissions are produced in a test pixel during a nonactive presentation time at step 530. In one embodiment of the present invention, a retrace time is utilized as the nonactive trace time. In one embodiment of the present invention, the test pixels are not in the active display area.

In step 540, a determination is made if the emissions in the test area are accurate. In one embodiment of the present invention, the current from the test pixels or dummy pixels is measured. In one embodiment of the present invention, the illumination from the test pixels or dummy pixels is measured. In one exemplary implementation of the present invention the measured current and/or illumination is compared to a predetermined level.

In step 550, adjustments to the pixels is made to provide a desired level. In one embodiment of the present invention, the voltage levels of driver signals are changed up or down to increase or decrease the emission current and/or illumination respectively.

Thus, the present invention is a system and method that facilitates comprehensible and clear presentation of information via a display by adjusting supply voltages to compensate for adverse changes in emission characteristics of display components. For example, in accordance with the present invention actually measuring what the current is (or some analog of what the current is) avoids problems associated with determining what environmental condition is causing the change. The present invention provides an accurate measure of what the change is and facilitates either increases or decreases in the drive to bring the current back to a predetermined or "normal" condition.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claimed is:

1. A display comprising:

active viewing pixels that are utilized to present an image; and testing pixels that are utilized to determine pixel deterioration, said testing pixels do not impact the active presentation of information and adjustments are made to the supply voltage for both said active viewing pixels and said testing pixels based upon a monitored emission from said testing pixels.

2. The display of claim 1 wherein said testing pixels are configured outside said active viewing area.

3. The display of claim 1 wherein a constant voltage is applied to said testing pixels.

4. The display of claim 1 wherein current emissions from said testing pixels are monitored.

5. The display of claim 1 wherein illumination emissions from said testing pixels are monitored.

6. The display of claim 1 wherein a supply voltage to said active viewing pixels and said testing pixels is altered based upon monitored current emissions from said testing pixels.

7. The display of claim 1 wherein a supply voltage to said active viewing pixels and said testing pixels is altered based upon monitored illumination emissions from said testing pixels.

8. The display of claim 1 wherein said testing pixels and said active pixels are configured in rows.

9. The display of claim 1 wherein said testing pixels and said active pixels are produced by field emission cathodes.

10. An emission compensation method comprising:

supplying a voltage driver;

presenting an image in an active pixel during an active presentation time;

producing emissions in a test pixel during a nonactive presentation time;

determining if the emissions in the test area are accurate; and adjusting the pixels to provide a desired level.

11. The emission compensation method of claim 10 wherein the voltage driver is provided with a signal from a high voltage power supply.

12. The emission compensation method of claim 10 wherein the pixels are created by field emission cathodes.

13. The emission compensation method of claim 10 wherein a retrace time is utilized as the nonactive trace time.

14. The emission compensation method of claim 10 wherein the test pixels are not in the active display area.

15. The emission compensation method of claim 10 further comprising:

measuring the current from the test pixels; and comparing the measured current to a predetermined level.

16. The emission compensation method of claim 10 further comprising:

measuring the illumination from the test pixels; and comparing the measured illumination to a predetermined level.

17. The emission compensation method of claim 10 further comprising changing the voltage levels of driver signals up or down to increase or decrease the emission current respectively.

18. The emission compensation method of claim 10 further comprising changing the voltage levels of driver signals up or down to increase or decrease the illumination respectively.

19. An emission adjusting display device comprising:

a multi-layer faceplate structure for generating an image; and a backplate structure for emitting electrons onto said multi-layer faceplate; said backplate including emitters for emitting said electrons, said emitters arranged in a plurality of rows and columns, wherein one of said plurality of rows of pixels is a dummy row to which a voltage is supplied and the resulting emission current is measured and adjustments are made to said voltage if the emission is not a predetermined value.

20. The emission adjusting display device of claim 19 wherein said dummy row of pixels is not within an active viewing area.

21. The emission adjusting display device of claim 19 voltage is supplied to the dummy row of pixels during a retrace period of the active viewing area.

22. The emission adjusting display device of claim 21 voltage is supplied once in a predetermined number of retrace periods.

23. The emission adjusting display device of claim 21 adjustment are made in quantified level of steps.

24. The emission adjusting display device of claim 21 the measure information is stored for later adjustment or transmission.

* * * * *